US011919666B2

(12) United States Patent
Sikora et al.

(10) Patent No.: US 11,919,666 B2
(45) **Date of Patent: *Mar. 5, 2024**

(54) STRAPPING TOOL

(71) Applicant: Golden Bear LLC, Columbus, OH (US)

(72) Inventors: Joshua Robert Sikora, Columbus, OH (US); Charles Russell Patzer, Columbus, OH (US)

(73) Assignee: Golden Bear LLC, Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/100,027

(22) Filed: Jan. 23, 2023

(65) Prior Publication Data

US 2023/0150705 A1 May 18, 2023

Related U.S. Application Data

(63) Continuation of application No. 17/332,768, filed on May 27, 2021, now Pat. No. 11,560,247.

(Continued)

(51) Int. Cl.
*B65B 13/32* (2006.01)
*B65B 13/18* (2006.01)

(Continued)

(52) U.S. Cl.
CPC ..... *B65B 13/327* (2013.01); *B65B 13/188* (2013.01); *B65B 13/22* (2013.01); *B65B 13/345* (2013.01); *B65B 13/187* (2013.01)

(58) Field of Classification Search
CPC ... B65B 13/025; B65B 13/187; B65B 13/188; B65B 13/22; B65B 13/24; B65B 13/305; B65B 13/327; B65B 13/34; B65B 13/345

(Continued)

(56) References Cited

U.S. PATENT DOCUMENTS 1,907,921 A * 5/1933 Williams ..... B65B 13/345 100/30
2,229,786 A * 1/1941 Abbott ..... B65B 13/305 254/250

(Continued)

FOREIGN PATENT DOCUMENTS

GB 428823 A * 5/1935 ..... B65B 13/30
GB 2040825 A * 9/1980 ..... B65B 13/30

(Continued)

OTHER PUBLICATIONS

PCT Form 210, International Search Report for PCT/US2019/019044, dated May 7, 2019.

(Continued)

*Primary Examiner* — Stephen F. Gerrity
(74) *Attorney, Agent, or Firm* — The Law Office of Patrick F. O'Reilly III, LLC

(57) ABSTRACT

A strapping tool is disclosed herein. In one or more embodiments, the strapping tool includes a motive power source and a sealing assembly. The sealing assembly includes a first punch and a die, the first punch and die configured to crimp or cut a notch in a strapping seal member and a piece of strapping so as to secure the piece of strapping around a package or bundle of items.

10 Claims, 12 Drawing Sheets

Related U.S. Application Data

(60) Provisional application No. 63/030,469, filed on May 27, 2020.

(51) Int. Cl.
*B65B 13/22* (2006.01)
*B65B 13/34* (2006.01)

(58) Field of Classification Search
USPC ..... 53/582, 592; 100/29, 30, 33 R; 140/93.4
See application file for complete search history.

(56) References Cited

U.S. PATENT DOCUMENTS 2,386,153 A 10/1945 Watt et al.
3,032,075 A * 5/1962 Hall ..... B65B 13/345 140/152
3,089,366 A 5/1963 Haraden
3,144,888 A * 8/1964 Palmer ..... B65B 13/345 140/93.2
3,291,163 A * 12/1966 Timmerbeil ..... B65B 13/305 140/93.2
3,329,178 A 7/1967 Plunkett
3,333,411 A 8/1967 Smith
3,333,608 A 8/1967 Kuoni
3,380,485 A * 4/1968 Plattner et al. ..... B65B 13/345 140/93.2
3,530,809 A 9/1970 Porter
3,552,450 A * 1/1971 Plunkett ..... B65B 13/345 140/93.4
3,654,033 A 4/1972 Angarola et al.
3,769,859 A * 11/1973 Sykes et al. ..... B65B 13/345 81/313
3,794,086 A * 2/1974 Hall et al. ..... B65B 13/30 140/93.2
3,799,835 A 3/1974 Gilmore
3,804,001 A 4/1974 Longerich et al.
3,810,495 A 5/1974 Pack
4,027,609 A 6/1977 Kerr
4,096,019 A 6/1978 Lehmann
4,166,422 A 9/1979 Porter
4,412,498 A 11/1983 Scholl
4,449,464 A 5/1984 Porter
4,545,234 A 10/1985 Schnellmann
4,739,700 A * 4/1988 Brouse et al. ..... B65B 13/30 100/29
4,791,968 A * 12/1988 Pearson ..... B65B 13/30 100/29
4,871,414 A 10/1989 Niedrig
5,476,569 A 12/1995 Harada
5,501,252 A * 3/1996 Bartzick et al. ..... B65B 13/30 140/93.2
5,526,761 A 6/1996 Mulcahey et al.
5,632,851 A 5/1997 Young
5,653,095 A 8/1997 Stamm
5,694,984 A 12/1997 Chueng
5,942,061 A 8/1999 Figiel et al.
5,954,899 A 9/1999 Figiel et al.
6,079,457 A * 6/2000 Crittenden ..... B65B 13/305 140/93.2
6,308,760 B1 10/2001 Finzo et al.
6,328,087 B1 12/2001 Finzo et al.
6,332,306 B1 12/2001 Finzo et al.
6,895,733 B2 5/2005 Nix
6,957,678 B2 10/2005 Scholl et al.
6,966,255 B1 11/2005 Crittenden
7,073,431 B1 7/2006 Chen
7,428,866 B2 9/2008 Reiche
8,578,997 B2 11/2013 Rauch
9,789,984 B2 10/2017 Sikora et al.
10,745,158 B2 8/2020 Sikora et al.
10,793,303 B2 10/2020 Sikora et al.
11,130,598 B2 9/2021 Sikora et al.
11,560,247 B2 * 1/2023 Sikora et al. ..... B65B 13/345
2009/0013656 A1 1/2009 Nasiatka et al.
2011/0056392 A1 3/2011 Neeser et al.
2011/0083596 A1 4/2011 Asao et al.
2012/0060735 A1 3/2012 Dickerson
2012/0085274 A1 4/2012 Bardh et al.
2013/0085053 A1 4/2013 Figiel et al.
2014/0007781 A1 1/2014 Sikora et al.
2014/0083311 A1 3/2014 Bonifazi et al.
2014/0290179 A1 10/2014 Keller
2015/0210411 A1 7/2015 Finzo et al.
2015/0321777 A1 11/2015 Nasiatka et al.
2016/0016682 A1 * 1/2016 Boss et al. ..... B65B 13/187 100/29
2016/0107775 A1 4/2016 Amacker et al.
2016/0167814 A1 6/2016 Figiel et al.
2017/0008652 A1 1/2017 Figiel et al.
2017/0166335 A1 * 6/2017 Nasiatka et al. ..... B65B 13/345
2017/0174374 A1 6/2017 Figiel et al.
2018/0037347 A1 2/2018 Sikora et al.
2018/0127124 A1 5/2018 Sikora et al.
2019/0241292 A1 8/2019 Boss et al.
2019/0256233 A1 8/2019 Sikora et al.

FOREIGN PATENT DOCUMENTS

GB 2040825 A 9/1980
GB 2055321 A * 3/1981 ..... B65B 13/305

OTHER PUBLICATIONS

PCT Form 237, Written Opinion of the International Searching Authority for PCT/US2019/019044, dated May 7, 2019.
PCT Form 210, International Search Report for PCT/US2021/034629, dated Aug. 31, 2021.
PCT Form 237, Written Opinion of the International Searching Authority for PCT/US2021/034629, dated Aug. 31, 2021.

* cited by examiner

Detail "A"

STRAPPING TOOL

CROSS-REFERENCE TO RELATED APPLICATIONS

This patent application is a continuation of U.S. patent application Ser. No. 17/332,768, entitled "Strapping Tool", filed on May 27, 2021, which claims priority to U.S. Provisional Patent Application No. 63/030,469, entitled "Strapping Tool", filed on May 27, 2020, the disclosure of each of which is hereby incorporated by reference as if set forth in their entirety herein.

This patent application also incorporates by reference in its entirety, U.S. Nonprovisional patent application Ser. No. 16/282,235, entitled "Strapping Tool", filed on Feb. 21, 2019, and U.S. Nonprovisional patent application Ser. No. 15/804,415, entitled "Strapping Tensioning And Sealing Tool", filed on Nov. 6, 2017, now U.S. Pat. No. 10,745,158.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a strapping tool. More particularly, the invention relates to a strapping tool that is configured to apply tension to a piece of strapping, and/or to notch or crimp a strapping seal member that secures end portions of the piece of strapping to one another.

2. Background

Various tools are known in the packaging art for performing numerous functions related to the manipulation of strapping, which is commonly used as a closing mechanism for packages, and as a convenient means for easily attaching two objects to one another (e.g., attaching a box to a pallet). Some of these conventional tools are powered directly from a centralized system, such as a building electrical system or a central pneumatic system. Other conventional packaging tools have a power supply that is an integral part of the tool. Both of the aforementioned types of conventional packaging tools have numerous limitations and drawbacks. For example, conventional combination strapping tools, which perform both tensioning and sealing operations, utilize a vast array of intricate components, resulting in these tools being heavy, overly complicated, and quite expensive.

Further, many of the various tools known in the packaging art notch or crimp a strapping seal member using jaws that squeeze the strapping seal member. Because such these conventional tools comprise many intricate components subject to failure, they are often not as reliable as desired by the users thereof.

Therefore, what is needed is a strapping tool that utilizes fewer and simpler components than conventional tools so as to reduce the overall complexity of the tool, and thereby provide a more cost effective alternative for performing strapping operations. Moreover, there is a need for a strapping tool that is more reliable than conventional strapping tools so as to minimize the disruption of strapping operations resulting from tool repairs and replacements. Furthermore, there is a need for a strapping tool that is easier to transport than conventional strapping tools. In addition, there is a need for a strapping tool that employs stamping, such as using a punch and die, rather than squeezing, to create a notch in a strap.

BRIEF SUMMARY OF EMBODIMENTS OF THE INVENTION

Accordingly, the present invention is directed to a strapping tool that substantially obviates one or more problems resulting from the limitations and deficiencies of the related art.

In accordance with one or more embodiments of the present invention, there is provided a strapping tool. The strapping tool includes a motive power source; and a sealing assembly. The sealing assembly includes a first punch and a die. The first punch and die are configured to crimp or cut a notch in a strapping seal member and/or a piece of strapping so as to secure the piece of strapping around a package or bundle of items.

In a further embodiment of the present invention, the motive power source comprises one of: (i) a pneumatic motor, (ii) an electric motor, (iii) a liquid fuel-based motor, (iv) a piston, and (v) a handle.

In another further embodiment of the present invention, the strapping tool may further comprise a cam member and a follower member. The cam member operatively couples the follower member to the motive power source, and the follower member cooperates with the die and is configured to position the die beneath the strapping seal member.

In still another further embodiment of the present invention, the strapping tool may further comprise an actuator operatively coupled to the motive power source. The actuator is configured to drive the first punch into the strapping seal member and/or the piece of strapping proximate to the die thereby crimping or cutting the notch in the strapping seal member and/or the piece of strapping.

In yet another further embodiment of the present invention, the strapping tool may further comprise a tensioning assembly operatively coupled to the motive power source. The tensioning assembly includes a cam member and at least one tensioning foot member. The cam member operatively couples the at least one tensioning foot member to the motive power source, and the at least one tensioning foot member of the tensioning assembly is configured to apply tension to the piece of strapping while being driven in an oscillatory manner by the motive power source.

In an alternate embodiment of the strapping tool described immediately above, the die may comprise a bottom support portion and a side support portion. The bottom support portion and the side support portion hold the strapping seal member in place during operation.

In a second alternate embodiment of the strapping tool described immediately above, the sealing assembly may further comprise a second punch, and the first punch is disposed in front of the die and the second punch disposed behind the die during operation.

In a third alternate embodiment of the strapping tool described immediately above, the strapping tool may further comprise a die lifting assembly, the die lifting assembly including a handle member operatively coupled to the die; and wherein, when the handle member is depressed by a user, the die is configured to be raised out of the strapping pass line of the strapping tool.

In still another further embodiment of the present invention, the strapping tool may further comprise a drive component operatively coupling the motive power source to the sealing assembly, the drive component configured to position the die beneath the strapping seal member.

In accordance with one or more other embodiments of present invention, there is provided a strapping tool. The strapping tool including a motive power source and a sealing assembly. The sealing assembly includes a die configured to hold a strapping seal member, a first punch, a second punch, a follower member, a cam member, a first actuator, and a second actuator. The follower member is configured to cooperate with the die so as to position at least a portion of the die beneath the strapping seal member. The cam member operatively couples the follower member to the motive power source. When positioned by the follower member, the die holds a strapping seal member.

The first punch and the second punch are respectively disposed in front of and behind the die to crimp or cut first and second notches, respectively, in the strapping seal member and/or a piece of strapping. The first and second actuators are coupled to the motive power source, and configured to drive the first punch and second punch, respectively, into the strapping seal member and/or the piece of strapping proximate to the die thereby notching or crimping the strapping seal member and/or the piece of strapping.

In another further embodiment of the present invention, the strapping tool may further comprise a tensioning assembly operatively coupled to the motive power source. The tensioning assembly may include a tensioning cam member and at least one tensioning foot member. The tensioning cam member operatively couples the at least one tensioning foot member to the motive power source, and the at least one tensioning foot member of the tensioning assembly is configured to apply tension to the piece of strapping while being driven in an oscillatory manner by the motive power source.

In still another further embodiment of the present invention, the die of the strapping tool may comprise a bottom support portion and a side support portion, the bottom support portion, and the side support portion may hold the strapping seal member in place during operation.

In yet another further embodiment of the present invention, the strapping tool may further comprise a die lifting assembly, the die lifting assembly including a handle member operatively coupled to the die; and wherein, when the handle member is depressed by a user, the die is configured to be raised out of the strapping pass line of the strapping tool.

In still yet another embodiment of the present invention, the motive power source comprises one of: (i) a pneumatic motor, (ii) an electric motor, and (iii) a liquid fuel-based motor.

In an alternate embodiment of the strapping tool described immediately above, the strapping tool further comprises a tensioning assembly, the tensioning assembly is configured to apply tension to the piece of strapping, and wherein the motive power source supplies power to both the sealing assembly and the tensioning assembly by means of a drive shaft.

In a second alternate embodiment of the strapping tool described immediately above, the strapping tool further comprises one or more one-way bearings disposed on the drive shaft so as to enable the tensioning assembly to be actuated by rotating the drive shaft in a first rotational direction and the sealing assembly may be actuated by rotating the drive shaft in a second rotational direction that is opposite to the first rotational direction.

In a second alternate embodiment of the strapping tool described immediately above, the strapping tool further comprises a single control button configured to control the operation of both the tensioning assembly and the sealing assembly.

In yet another further embodiment of the present invention, the sealing assembly further comprises an additional die that is configured to remain stationary.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Figure 1:
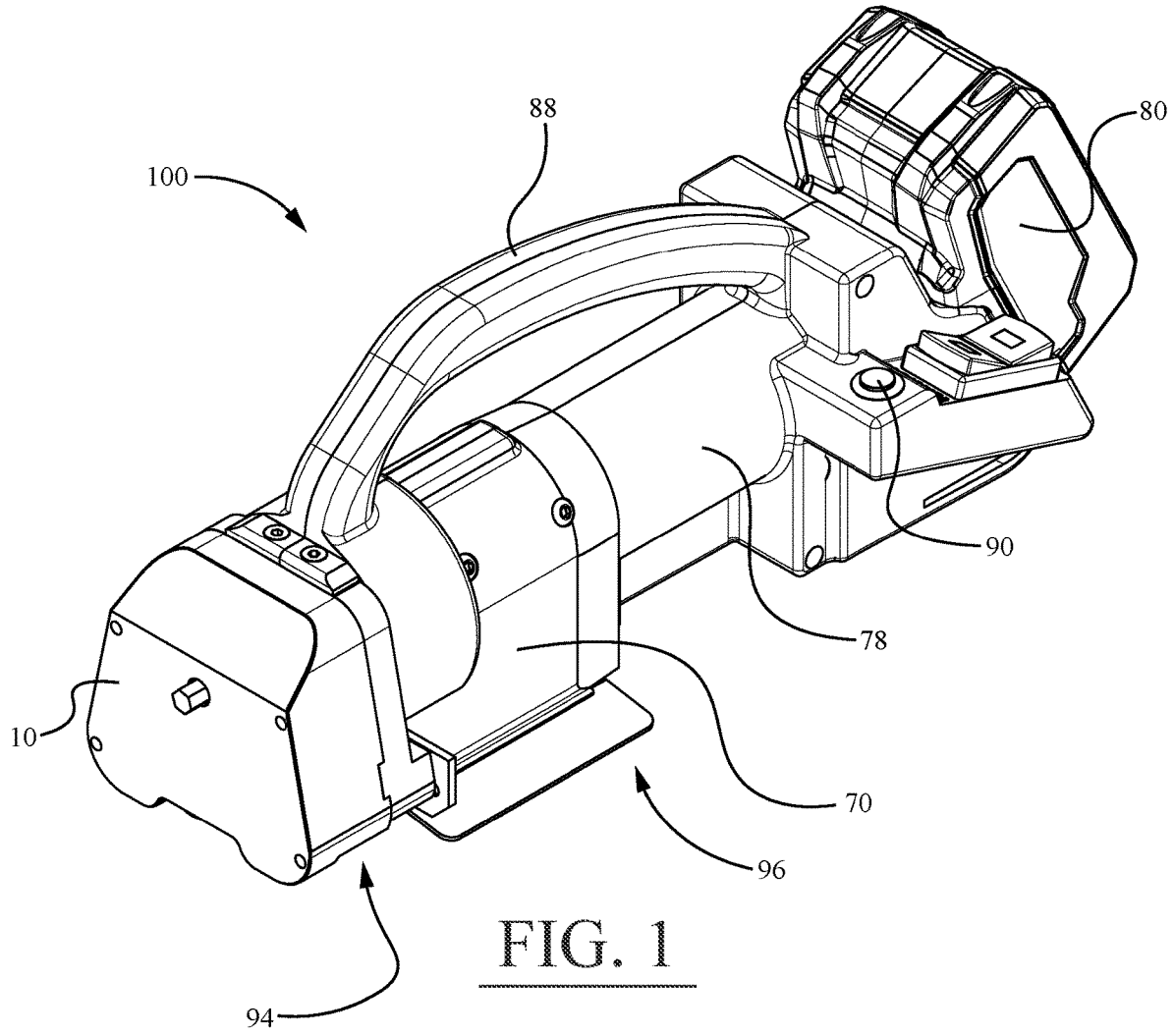
FIG. 1 is an assembled perspective view of a strapping tool, according to a first embodiment of the invention.

It should be understood all references to direction and position in the drawings, unless otherwise indicated, refer to the orientation of the strapping tools as presented in the drawings. For example, in FIG. 7*b* and other front end views depicted in the drawings, the left side of the tool refers to the left side of the front end view, and the right side of the tool refers to right side of the front end view.

Throughout the figures, the same parts are always denoted using the same reference characters so that, as a general rule, they will only be described once.

DRAWING REFERENCE NUMERALS

The following reference characters identify the associated elements depicted in the drawings describing the present invention:

| Ref. | Element |
|---|---|
| 10 | Front Housing Member |
| 16a | Right Die |
| 16b | Left Die |
| 17a | Right Upper Die Pin |
| 17b | Left Upper Die Pin |
| 18a | Right Lower Die Pin |
| 18b | Left Lower Die Pin |
| 20 | Front Punch |
| 21 | Front Punch Pin |
| 22 | Rear Punch |
| 23 | Rear Punch Pin |
| 28 | Follower Member |
| 30 | Rear Spline |
| 32 | Front Spline |
| 50 | Cutter |
| 51 | Seal Stop |
| 52 | Holding Leg |
| 53 | Leg Pin |
| 54 | Holding Foot |
| 55 | Foot Bracket |
| 56 | Strap Pinch Pin |
| 57 | Foot Bracket Screw |
| 58 | Tension Foot |
| 59 | Foot Pin |
| 60 | Tension Leg |
| 61 | Screw |
| 62 | Punch Actuator (Rear) |
| 63 | Cutter Roller |
| 64 | Rear Punch Housing |
| 65 | Punch Actuator (Front) |
| 66 | Cutter Blade Pin |
| 67 | Cutter Actuator |
| 68 | Front Screw |
| 69 | Rear Screw |

-continued

| Ref. | Element |
|---|---|
| 70 | Cover Plate |
| 71 | Side Plate |
| 72 | Tension Frame Housing |
| 74 | Plate Member |
| 75 | Screw |
| 77 | Gear Reducer and Drive Assembly |
| 76 | Tension Cam Bracket |
| 78 | Motive Power Source |
| 79 | Strap Ramp |
| 80 | Battery Pack |
| 81a | First Housing Portion |
| 81b | Second Housing Portion |
| 88 | Upper Handle Portion |
| 90 | Control Button |
| 94 | Sealing Assembly |
| 96 | Tensioning Assembly |
| 100 | First Example Strapping Tool |
| 102 | Strapping |
| 106 | Strapping Seal Member |
| 108 | Notched Portion of Seal Member |
| 110 | Punch and Die Actuator |
| 112 | Die Cam |
| 114 | Gear Reducer |
| 115 | Rear Bearing |
| 116 | Front Bearing |
| 117 | Central Portion of Gear Reducer |
| 118 | Drive Shaft |
| 120 | Punch and Die Driver Assembly |
| 122 | Punch and Die Driver Subassembly |
| 200 | Second Example Strapping Tool |
| 216 | Stationary Die |
| 217 | Moveable Die |
| 228 | Follower Member |
| 300 | Third Example Strapping Tool |
| 316 | Stationary Die |
| 317 | Movable Die |
| 318 | Drive Shaft |
| 320 | Front Punch |
| 328 | Actuator Link |
| 365 | Punch Link |
| 394 | Sealing Assembly |
| 396 | Tensioning Assembly |
| 386 | Displaceable Handle Portion |
| 388 | Stationary Handle Portion |

DETAILED DESCRIPTION OF EMBODIMENTS OF THE INVENTION

A first illustrative embodiment of the strapping tool is seen generally at 100 in FIGS. 1-13*f*. An exploded perspective view of the assemblies that form the strapping tool 100 is depicted in FIG. 6.

Figure 2:
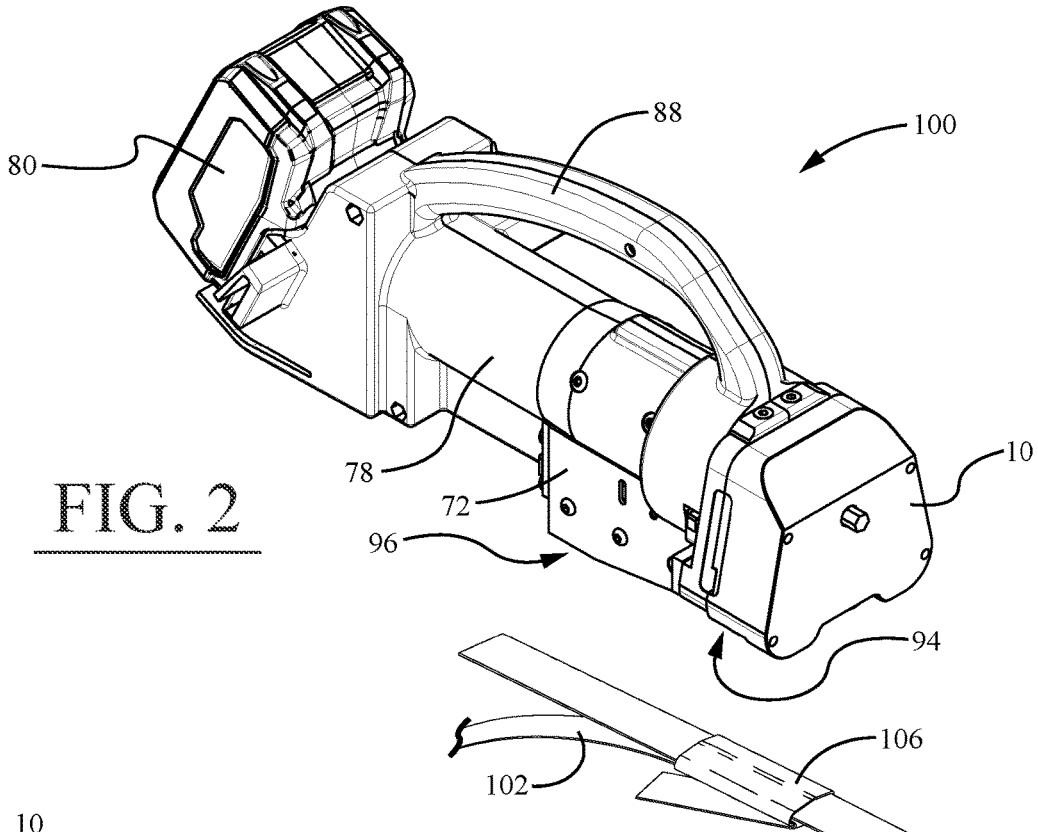
FIG. 2 is another perspective view of the strapping tool of FIG. 1, wherein the opposite side of the strapping tool is illustrated together with a piece of strapping and seal member.
Figure 3:
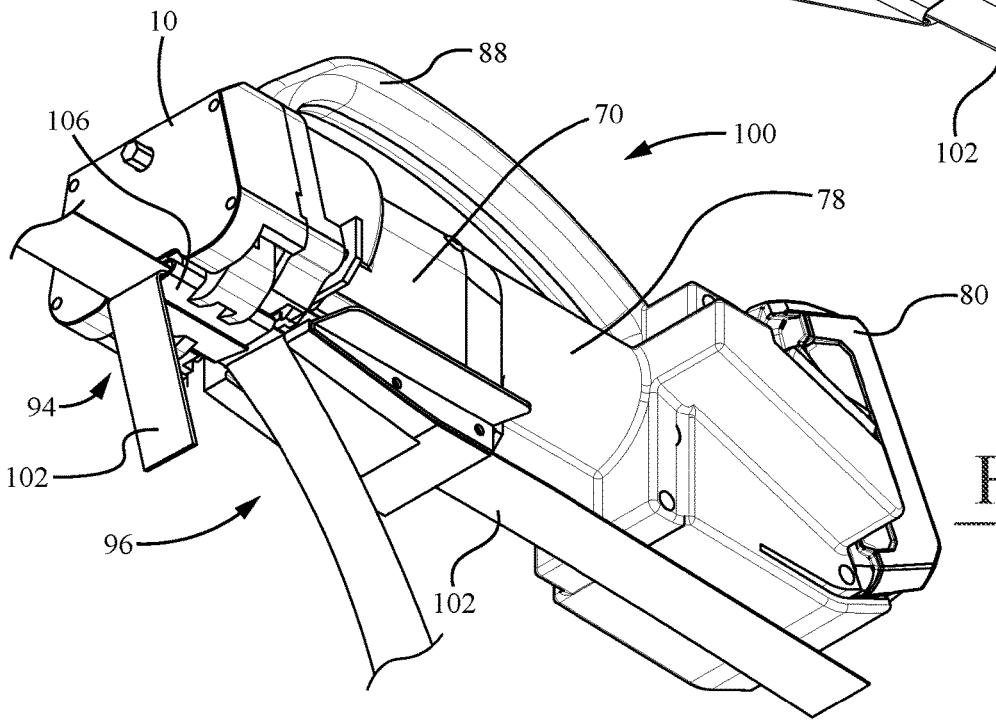
FIG. 3 is a bottom perspective view of the strapping tool of FIG. 1, wherein the strapping tool is shown notching a seal member of a piece of strapping.

Initially with reference to the illustrative embodiment of FIGS. 1-3, the strapping tool 100 may be operated by a user using handle 88 and control button 90. Further, it can be seen that the strapping tool 100 generally comprises a motive power source 78; a tensioning assembly 96 operatively coupled to the motive power source 78, and configured to apply tension to a piece of strapping 102; and a sealing assembly 94 operatively coupled to the motive power source 78, and configured to notch a strapping seal member 106 so as to secure a piece of strapping 102 (see FIGS. 2 and 3) around a package or bundle of items.

In the illustrative embodiment, the internal components of the sealing assembly 94 are housed within the front housing member 10 of the strapping tool 100. The internal components of the tensioning assembly 96 are housed behind and protected by cover plate 70. The front housing member 10 encloses the constituent components of the sealing assembly 94. Also, as shown in FIGS. 1-3, it can be seen that that the strapping tool 100 is provided with a rechargeable battery pack 80 that is removable from its battery mount on the rear end portion of the strapping tool 100 so that the battery 80 can be easily charged. In the illustrative embodiment, the rechargeable battery pack 80 is capable of powering both the electric motor 78 that drives both the tensioning assembly 96 and the sealing assembly 94.

In the illustrative embodiment, the strapping tool 100 further comprises a control system operatively coupled to the electric motor 78 for controlling the operation of the tensioning and sealing assemblies 96, 94. As shown, the control system of the illustrative strapping tool 100 includes a single control button 90 configured to control the operation of both the tensioning assembly 96 and the sealing assembly 94 (i.e., when depressed by a user, the control button 90 initiates the tensioning and sealing operations of the strapping tool 100). Although, while a single control button 90 is used in the illustrative embodiment, in other alternative embodiments, the control system of the strapping tool 100 may include a plurality of control buttons or manual controls for controlling the tensioning and sealing operations of the tool 100. In these alternative embodiments, at least a first one of the control buttons may be configured to control the operation of the tensioning assembly 96, while at least a second one of the control buttons may be configured to control the operation of the sealing assembly 94. In the illustrative embodiment, the control system of the strapping tool 100 further comprises a microcontroller for performing the central processing operations for the control of the strapping tool 100.

Figure 4:
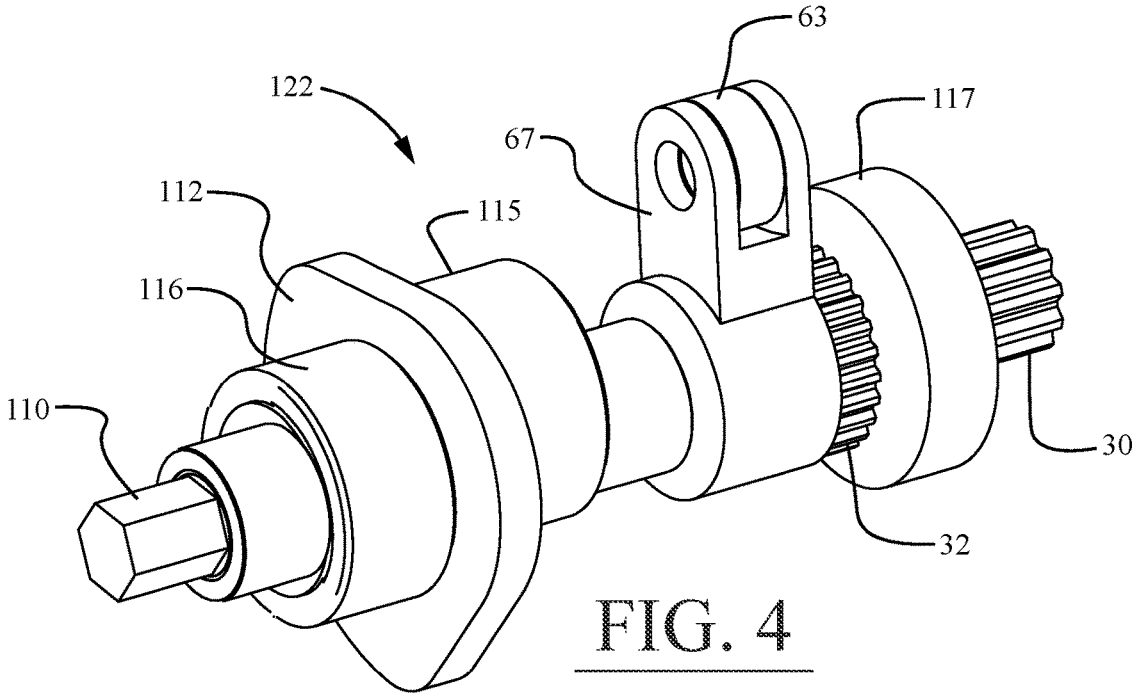
FIG. 4 is a first perspective view of a punch and die driver assembly of the strapping tool of FIG. 1.
Figure 5:
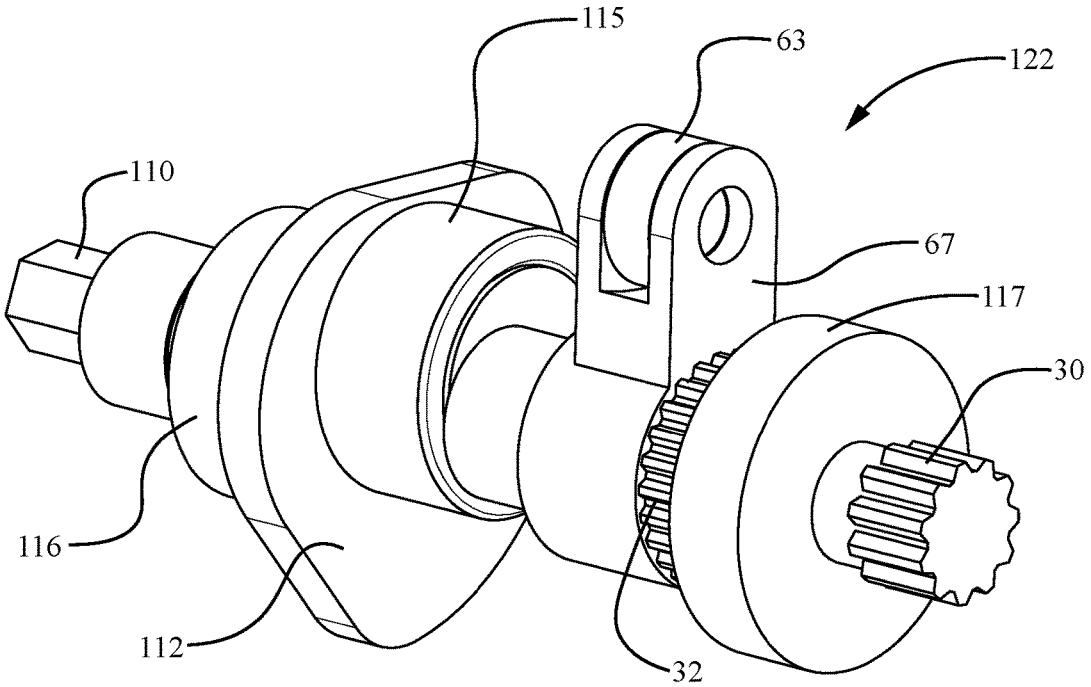
FIG. 5 is a second perspective view of a punch and die driver assembly of the strapping tool of FIG. 1.
Figure 6:
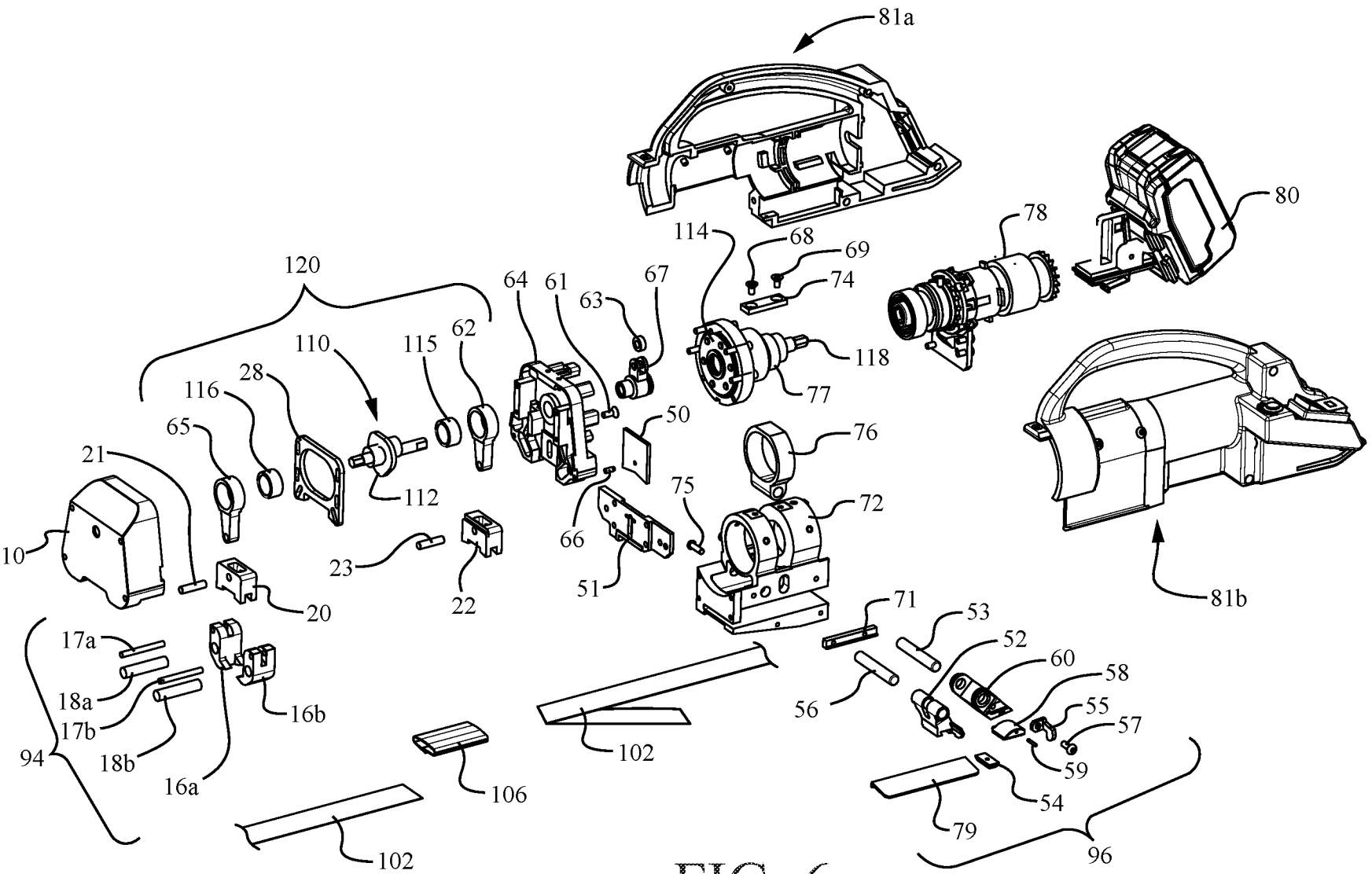
FIG. 6 is an exploded perspective view of the strapping tool of FIG. 1.

Referring now to FIGS. 4-6, punch and die driver assembly 120 with punch and die driver subassembly 122 is shown. It can be seen that the sealing assembly receives motive power via punch and die driver assembly 120. The motive power source 78 delivers power via drive shaft 118 which drives punch and die actuator 110, front punch actuator 65 (best shown in FIG. 6), and rear punch actuator 62. Punch and die actuator 110 includes a cam 112 that cooperates with a lifter or follower element 28 to raise and lower dies into position. Punch and die assembly 120 further includes bearings 115, 116 which receive the rotation of punch and die actuator 110. Bearing 115 is disposed in the space between a cam formed in punch and die actuator 110 and rear punch actuator 62. Bearing 116 is disposed in the space between a cam formed in punch and die actuator 110 and front punch actuator 65.

Driver assembly further includes 5:1 gear reducer 114 for controlling rotational power received from drive shaft 118. The rear spline 30 is on the input side of the gear reducer 114, while the front spline 32 is on the output side of the gear reducer 114. The cutter actuator 67 is also driven by the drive shaft 118 that provides power to the sealing assembly 94 and the tensioning assembly 96. The cutter actuator 67 revolves around the drive shaft 118 and physically pushes the cutting blade 50 down through the strapping, thereby slicing the excess end portion of the strap so that it can be removed from the remainder of the strap.

Figure 9:
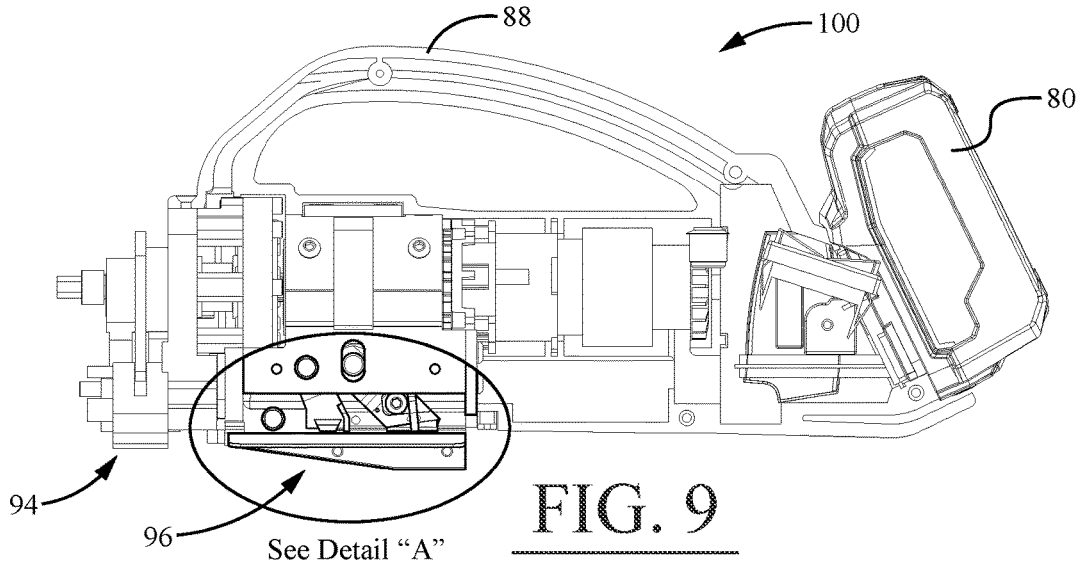
FIG. 9 is a side elevational view of the strapping tool of FIG. 1, wherein the front cover of the sealing assembly has been removed, and the cover of the tensioning assembly has been removed so as to illustrate the internal components of the tensioning assembly.
Figure 10:
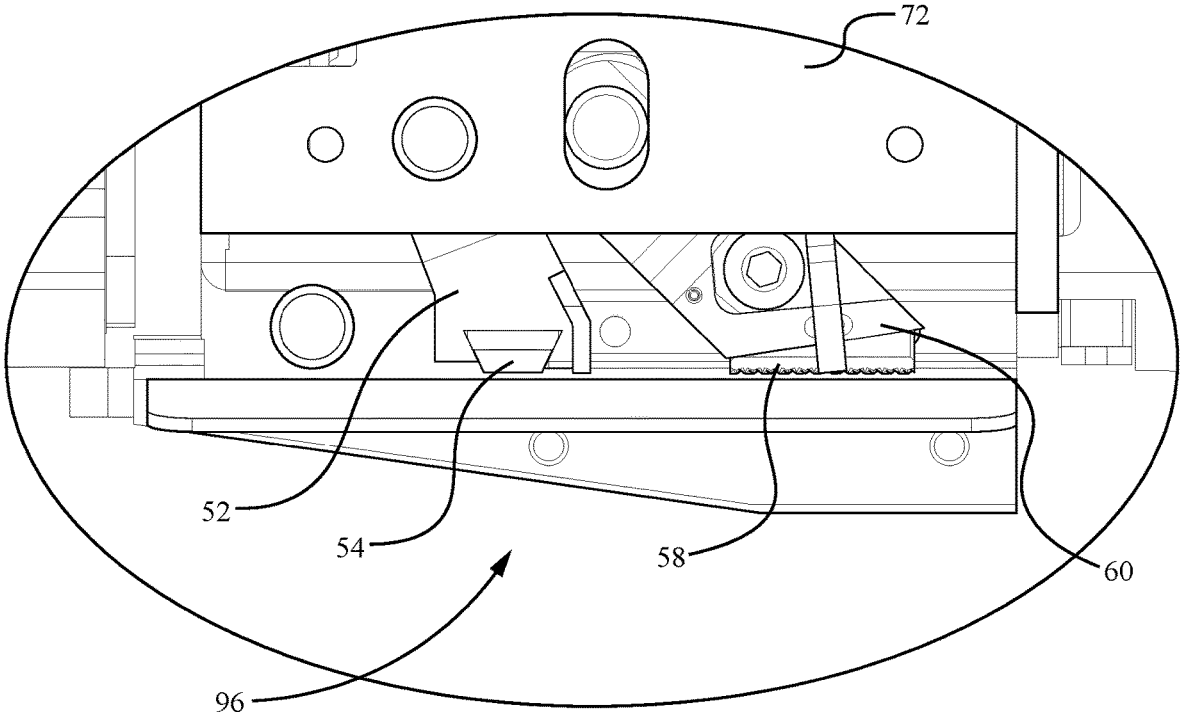
FIG. 10 is an enlarged partial side view of the tensioning assembly (Detail "A")
Figure 11:
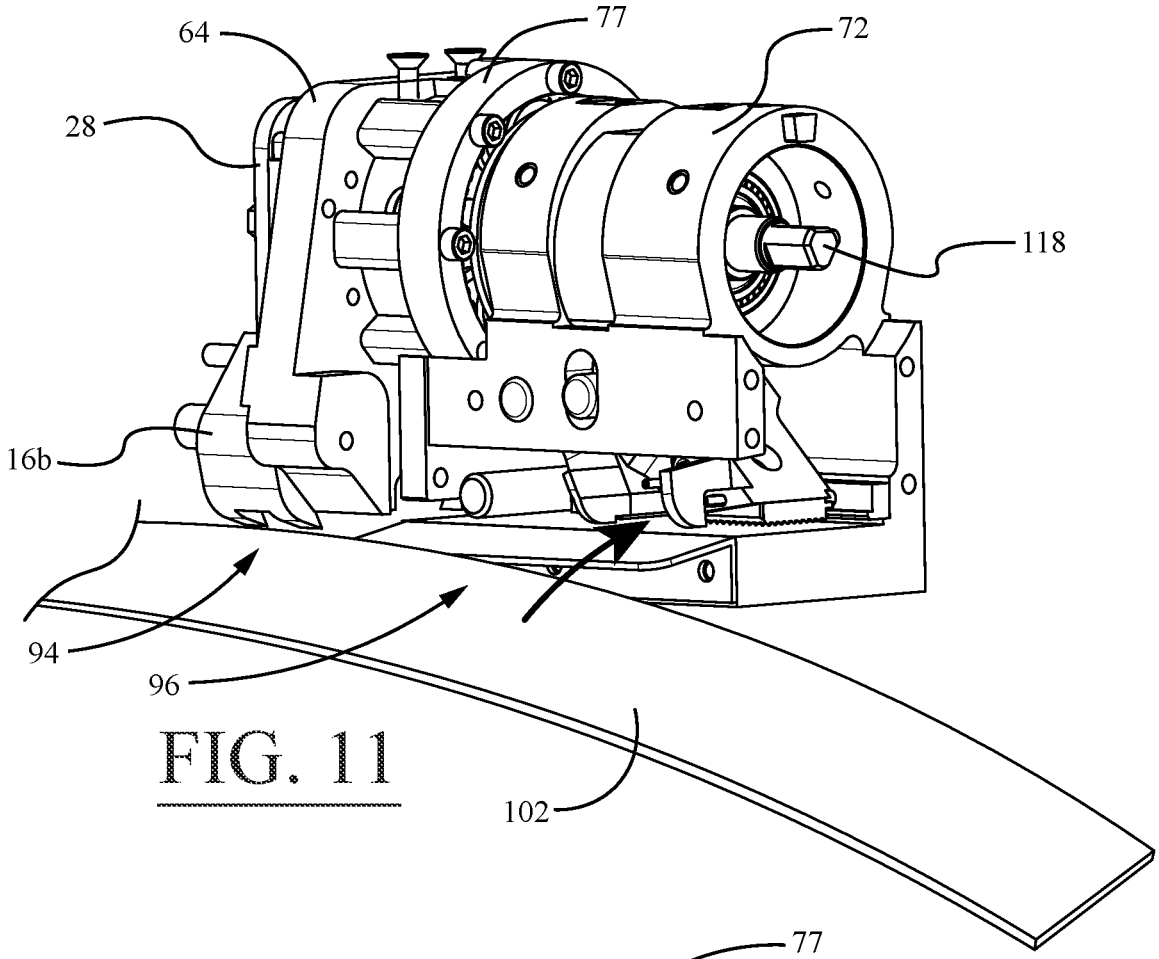
FIG. 11 is a side perspective view of the sealing assembly and tension assembly of the strapping tool of FIG. 1.
Figure 12:
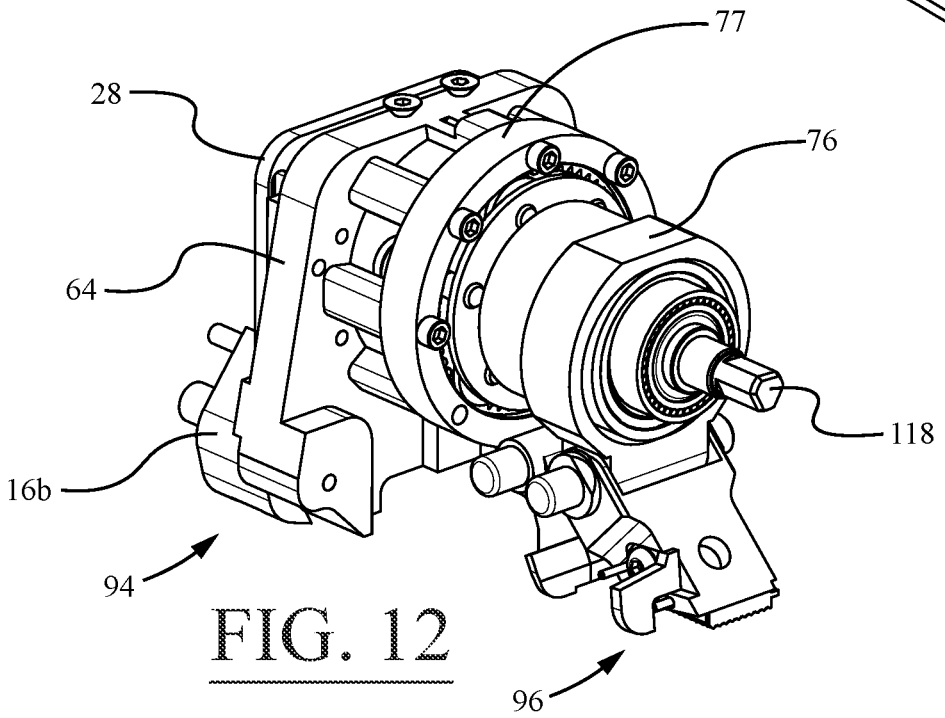
FIG. 12 is a side perspective view of the sealing assembly and tension assembly of the strapping tool of FIG. 1, illustrating components of the tension assembly.

As shown in the exploded view of FIG. 6, in the illustrative embodiment, the tensioning assembly 96 of the strapping tool 100 comprises a holding leg 52, a holding foot 54, a holding leg pin 56, a tension leg 60, a tension foot 58, and a tension leg pin 53. Tensioning assembly further comprises a tension frame housing 72, and a tension cam bracket 76. When the piece of strapping 102 is being tensioned (as shown in FIGS. 9-11), the holding leg 52 with associated holding foot 54 holds the strap 102 in place so that the strap is unable to slide in a direction opposite to the tensioning direction. In the illustrative embodiment, the holding leg 52 is pivotally mounted to the tension frame housing 72 by means of the holding bar pin 56. During the tensioning of the strap 102, the holding leg 52 is not driven by the motor 78, but rather is manually pivotable about the holding leg pin 56. In the illustrative embodiment, the holding foot 54, which is disposed at the bottom of the holding leg 52, may be formed from a suitable steel material so that the holding foot 54 is able to frictionally engage, and hold the strap 102 in place as it is being tensioned (see FIGS. 9-11). The tensioning foot member 58, which is driven by the motor 78 during the tensioning of the strap 102, is pivotable about the tension leg pin 53 during the tensioning of the strap 102. The tension leg pin 53 connects the tension leg 60 to the tension cam bracket 76, and is received within an oval-shaped aperture in the tension frame housing 72.

As shown in FIG. 6, the tension leg 60 is provided with a bracket 55 mounted to a side thereof by means of a screw 57. The bracket 55 prevents the grinding of the tensioning foot member 58 on the deck of the tensioning assembly 96.

Referring again to FIGS. 1-3, in the illustrative embodiment, the motor 78 supplies power to both the sealing assembly 94 and the tensioning assembly 96 by means of the single drive shaft 118. In the illustrative embodiment, with reference to the punch and die driver subassembly 122 depicted in FIGS. 4 and 5, the strapping tool 100 further comprises a plurality of one-way bearings 115, 116 disposed on the punch and die actuator 110 and a one-way bearing provided as part of the gear reducer and drive assembly 77 so as to enable the tensioning assembly 96 to be actuated by rotating the drive shaft 118 in a first rotational direction (e.g., a counterclockwise direction), and the sealing assembly 94 and the cutting operations to be actuated by rotating the drive shaft 118 in a second rotational direction (e.g., a clockwise direction) that is opposite to the first rotational direction. As a result of the one-way bearings 115, 116, the punch and die actuator 110 does not rotate when the drive shaft 118 rotates in the first rotational direction, and the tension cam member does not rotate when the drive shaft 118 rotates in the second rotational direction.

While one-way bearings 115, 116 are utilized in the illustrative embodiment for regulating the tensioning, sealing, and cutting operations of the strapping tool 100, other means for controlling the directional rotation of the punch and die actuator 110 may be used. For example, in one or more alternative embodiments, a clutch subassembly may be operatively coupled to the drive shaft 118 rather than the one-way bearings 115, 116 so as to enable the tensioning assembly 96 to be actuated by rotating the drive shaft 118 in a first rotational direction and the sealing assembly 94 and the cutting operations to be actuated by rotating the drive shaft 118 in a second rotational direction that is opposite to the first rotational direction. As another example, in one or more other alternative embodiments, a one-way ratchet subassembly or one-way indexing subassembly may be operatively coupled to the cam drive shaft 118 rather than the one-way bearings 115, 116 so as to enable the tensioning assembly 96 to be actuated by rotating the drive shaft 118 in a first rotational direction and the sealing assembly 94 and the cutting operations to be actuated by rotating the drive shaft 118 in a second rotational direction that is opposite to the first rotational direction.

In the illustrative embodiment, the motive power source 78 is in the form of electric motor powered by the battery pack 80. However, in other embodiments, other types of motive power sources may be used, such as pneumatic motors, liquid fuel-based motors (e.g., gasoline-powered motors), motors driven by mechanical spring assemblies, and manually-actuated power sources (e.g., a power source driven by the turning of a crank by user, etc.).

Also, while a single electric motor 78 drives both the tensioning assembly 96 and the sealing assembly 94 in the illustrative embodiment, separate motors may be used for the tensioning and sealing assemblies 96, 94 in alternative embodiments.

Next, with reference primarily to FIGS. 4-6, 7*a*-8*b*, and 13*a*-13*f*, the sealing assembly 94 of the illustrative strapping tool 100 will be described in detail. In the illustrative embodiment, referring initially to FIGS. 4-6 and 7*a*-7*b*, it can be seen that the sealing assembly 94 generally includes a punch and die actuator 110, a follower member 28 and a pair of die members 16*a*, 16*b*. As shown in FIGS. 4-6, the punch and die actuator 110 of the sealing assembly 94 comprises the punch and die actuator 110 coupled to the drive shaft 118 driven by motor 78. In the illustrative embodiment, the punch and die actuator 110 is eccentric, and thus has a variable radii cam surface geometry. Also, in the illustrative embodiment, the sealing assembly 94 comprises the pair of die members 16*a* and 16*b*. As shown in FIGS. 6 and 13*a*-13*f*, it can be seen that the die members, 16*a* and 16*b*, each comprise cutting surfaces for forming the notched portions 108 in the seal member 106 (see FIG. 8*a*). In addition, referring to FIGS. 4 and 6, the punch and die actuator 110 is operatively coupled to the electric motor 78 by means of the drive shaft 118 (i.e., the punch and die actuator 110 is rotated by the drive shaft 118). The punch and die actuator 110 is operatively coupled to the front pair of die members, 16*a* and 16*b*, by the follower member 28 so as to selectively activate the pair of die members 16*a* and 16*b* (see FIGS. 7*b*, 8*b* and 13*a*-13*f*). In the illustrative embodiment, the follower member 28 is in the form of a plate member with a central aperture formed therein for receiving the cam 112 of the punch and die actuator 110. In the illustrative embodiment, the punch and die driver subassembly 122 of the sealing assembly 94 may be in the form of a positive drive shaft with cam 112 where the follower member 28 is disposed around, and circumscribes the cam 112 of the punch and die actuator 110.

Now, with reference primarily to FIGS. 6 and 9-12, the functionality of the tensioning assembly 96 of the strapping tool 100 will be described. Initially, when the drive shaft 118 is driven in a tensioning direction by the motor 78, the tension cam bracket 76, which acts as a follower, is either driven up or down by a tension member, which may be in the form of an eccentric cam member in the illustrative embodiment. In turn, the up and down displacement of the tension bracket 76 causes the tensioning leg member 60, which is operatively coupled to the tension bracket 76 by the pin 53, to oscillate backwards and forwards so as to apply tension to the strap 102. In other embodiments, the displacement of the tension bracket 76 may include lateral displacements as well as the generally vertical displacements of the illustrative embodiment (e.g., the tension cam bracket 76 may be diagonally displaced). In particular, referring to FIG. 11, it can be seen that the end of the strap 102 being tensioned initially is loaded into the tension assembly 96 before tension has been applied thereto. Then, as tension is being applied to the strap 102 during a cycle by the tensioning foot 58 on the end of the tensioning leg member 60, the end of the strap 102 has been displaced backward (i.e., the strap 102 has been displaced to the right in FIG. 11). When the tensioning foot 58 is disposed in its tensioning position, the tension cam bracket 76 is driven downwardly so that the tensioning foot 58 is pushed downwardly against the strap 102 for tensioning. After tension has been applied to the strap 102 during the tensioning cycle, tension assembly 96 maintains the tension force thereon throughout the tensioning operation until the strap 102 is notched by punches 20 and 22. In the illustrative embodiment, during the tensioning operation of the strapping tool 100, the tensioning foot 58 advances the tensioned strap 102 a predetermined amount (e.g., about one-eighth of an inch) during each cycle. During the tensioning operation, the tensioning foot 58 continually grabs and pulls a predetermined amount of strapping 102 through the seal member and the holding foot 54 prevents the strapping 102 from slipping back. During each tensioning cycle, the foot 58 resets and grabs another predetermined amount of strap 102 (e.g., about one-eighth of an inch) as it is forced down and out the back of the tool 100. After sufficient tension is applied to the strap, the tensioning operation is concluded, and the sealing operations described hereinafter are performed.

Figure 7A:
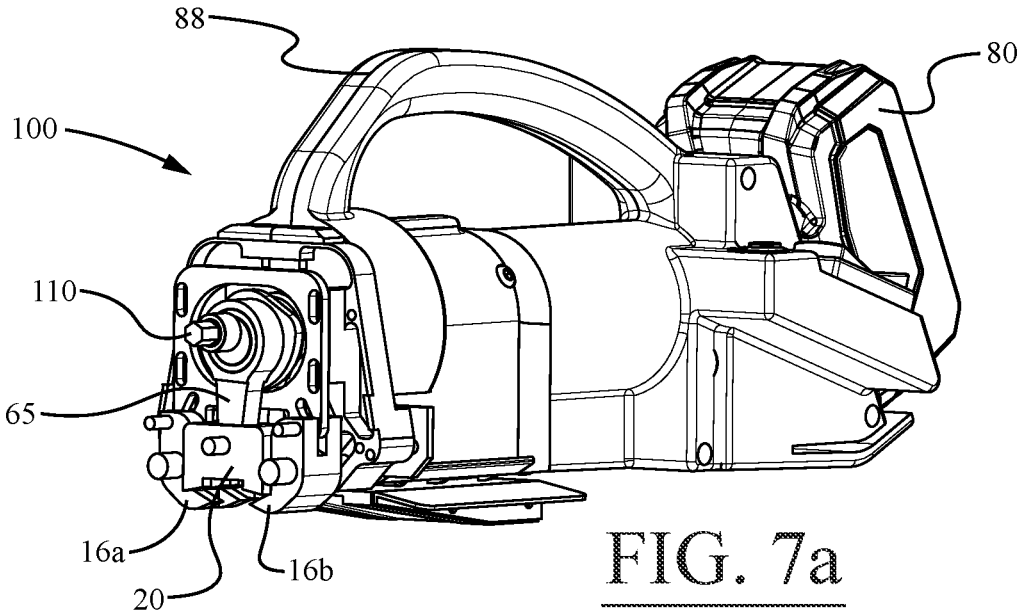
FIG. 7*a* is a perspective view of the strapping tool of FIG. 1, wherein the front cover of the sealing assembly has been removed, and the dies are in a sealing position and the front and rear punches are raised.
Figure 8A:
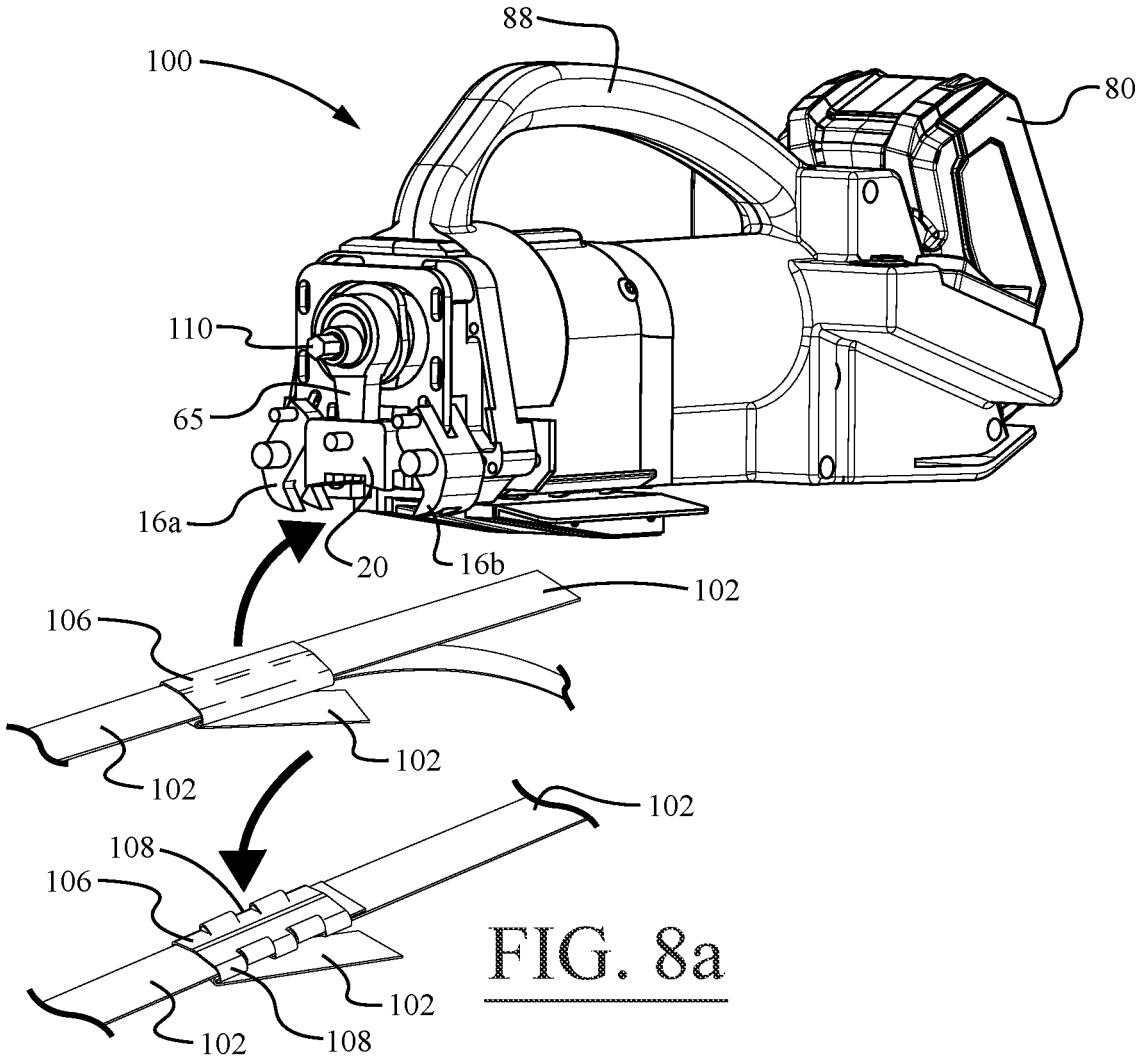
FIG. 8*a* is a perspective view of the strapping tool of FIG. 1, wherein the front cover of the sealing assembly has been removed, and the dies are in a loading position and the front and rear punches are raised.
Figure 7B:
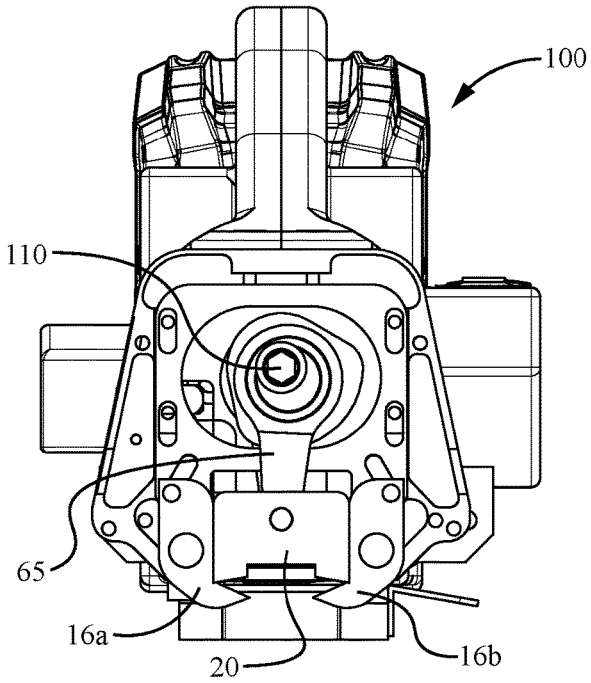
FIG. 7*b* is a front elevational view of the strapping tool of FIG. 1, wherein the front cover of the sealing assembly has been removed, and the dies are in a sealing position and the front and rear punches are raised.
Figure 8B:
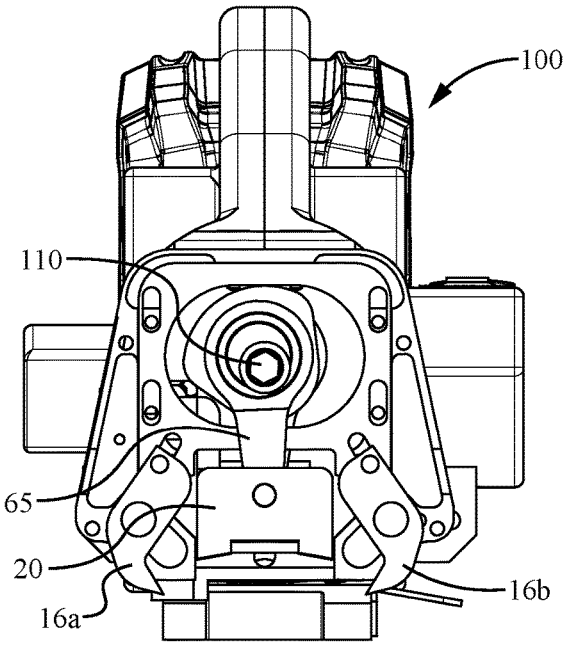
FIG. 8*b* is a front elevational view of the strapping tool of FIG. 1, wherein the front cover of the sealing assembly has been removed, and the dies are in a loading position and the front and rear punches are raised.

Referring now to FIGS. 7*a*-8*b* and 13*a*-13*f*, strapping tool 100 is illustrated in various configurations throughout a sealing operation. Each configuration of strapping tool 100 is based on a rotated position of drive shaft 118. In FIGS. 8*a* and 8*b*, the strapping tool 100 is illustrated in a configuration operative to receive strap 102 and sealing member 106. As shown, the drive shaft 118 of strapping tool 100 is disposed in a position such that dies 16*a* and 16*b* are rotated to an open position, thereby enabling a user to load the strapping tool 100 with strap 102 and sealing member 106 into the tensioning assembly 96 of the tool.

Referring now to FIGS. 7*a* and 7*b*, drive shaft 118 is illustrated as having been rotated from the position shown in FIGS. 8*a* and 8*b* such that the punch and die actuator 110 has forced dies 16*a* and 16*b* into a closed position in preparation for receiving punches 20 and 22 during the sealing operation.

Figure 13A:
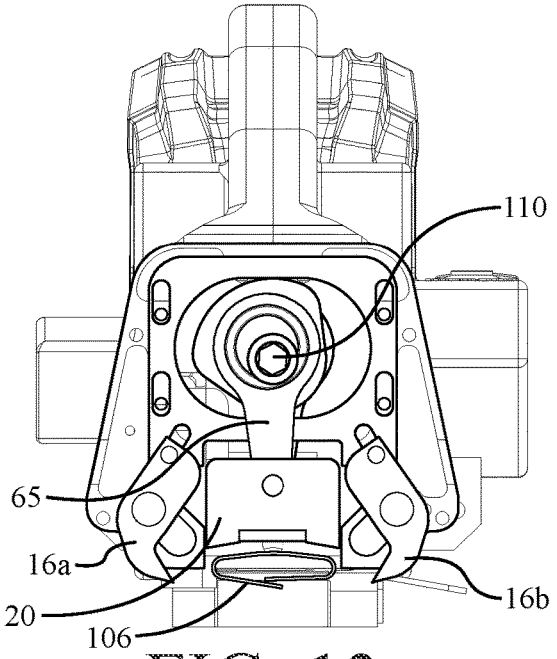
FIGS. 13*a*-13*f* are a series of front end views of the internal components of the sealing assembly of the strapping tool of FIG. 1, illustrating the sealing assembly at various phases of operation.

FIGS. 13*a*-13*f* sequentially illustrate the configurations of sealing tool 100 during successive phases of the sealing operation. FIG. 13*a*, illustrates the strapping tool in a configuration similar to that shown in FIGS. 8*a* and 8*b*, with a strap 102 and sealing member 106 loaded into the tool.

Figure 13B:
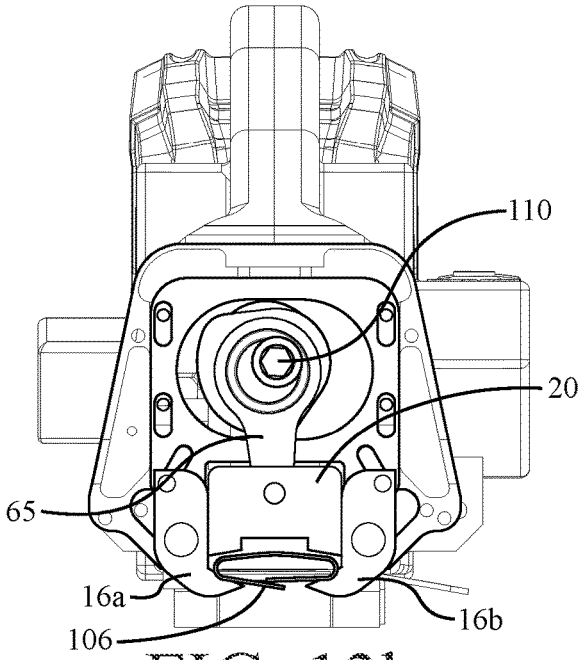

FIG. 13*b* illustrates the strapping tool 100 in a second phase of the sealing process. Drive shaft 118 is rotated such that dies 16*a* and 16*b* are positioned to receive punches 20 and 22 during the sealing operation. The configuration illustrated in FIG. 13*b* is the same as that of FIGS. 7*a* and 7*b* except that in FIG. 13*b* the tool is operating on strap 102 and sealing member 106.

Figure 13C:
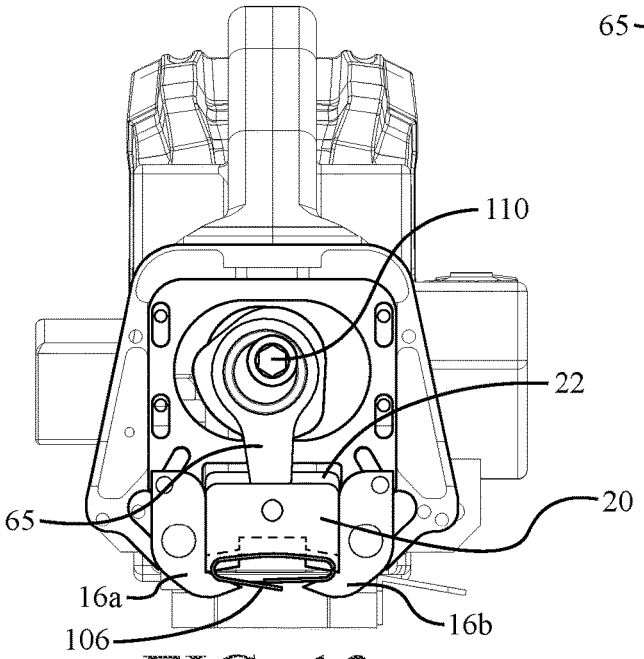

FIG. 13*c* illustrates the strapping tool 100 in a third phase of the sealing process. Drive shaft 118 is further rotated by the motor 78 such that front punch 20 is thrust straight downward into sealing member 106 thereby creating a first notch in sealing member 106 and strap 102. As such, the front punch 20 is configured to penetrate both the strapping seal member 106 and the piece of strapping 102 during the crimping or notching of the strapping seal member 106 and the piece of strapping 102. During this phase, die members 16*a* and 16*b* remain positioned as illustrated in FIG. 13*b*.

Figure 13D:
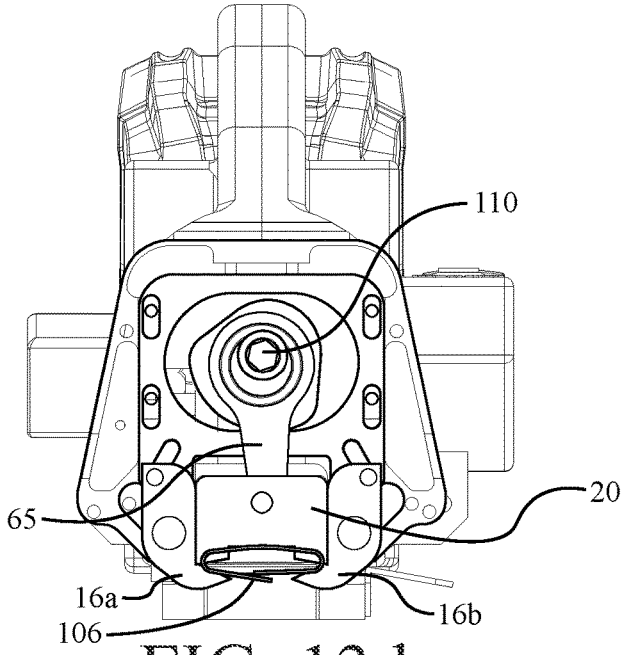

FIG. 13*d* illustrates the strapping tool 100 in a fourth phase of the sealing process. Drive shaft 118 is further rotated by the motor 78 such that rear punch 22 is thrust straight downward into sealing member 106 thereby creating a second notch in sealing member 106 and strap 102. During this phase, die members 16*a* and 16*b* remain positioned as illustrated in FIG. 13*b*.

Figure 13E:
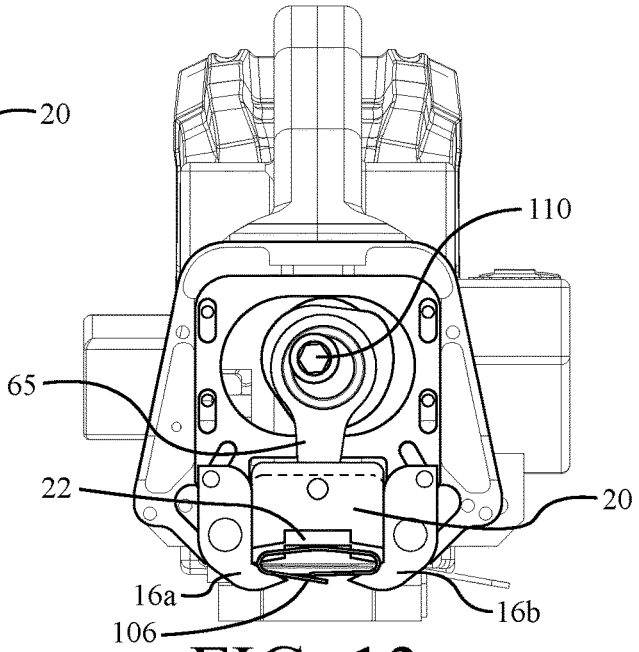

FIG. 13*e* illustrates the strapping tool 100 in a fifth phase of the sealing process. Drive shaft 118 is further rotated by the motor 78 such that front punch 20 is raised and cleared from the first notch in sealing member 106.

Figure 13F:
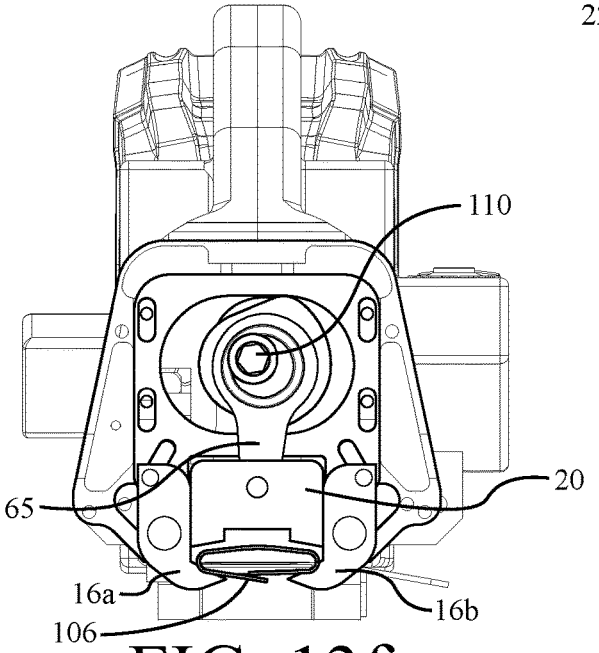

FIG. 13*f* illustrates the strapping tool 100 in a sixth phase of the sealing process. Drive shaft 118 is further rotated by the motor 78 such that rear punch 22 is raised and cleared from the second notch in sealing member 106. Upon further rotation of drive shaft 118 by motor 78, sealing tool 100 will be configured with dies 16*a* and 16*b* rotated such that they are open, and punches 20 and 22 are raised sufficiently to allow strap 102 and notched sealing member 106 to be removed from the sealing tool. Once so removed, sealing tool 100 is configured to receive another strap 102 and sealing member 106, and begin the sealing process again, as shown in FIGS. 8*a* and 8*b*.

It should be understood that the phases of the sealing operation described with respect to FIGS. 13*a*-13*f* do not need to be completely discrete with respect to one another. For example, the closing of dies 16*a* and 16*b* (as illustrated in FIG. 13*b*) may not be completely finished before punch 20 begins to be thrust downward (as illustrated in FIG. 13*c*). Likewise, either or both of punches 20 and 22 may still be rising as dies 16*a* and 16*b* are rotated into their open configurations (as shown in FIGS. 8*a*, 8*b*, and 13*a*).

In an alternative embodiment, the punches 20 and 22 may be configured to be driven down in unison, rather than the front punch 20 being thrust downward into the seal member 106 prior to the rear punch 22 being thrust downward into the seal member 106.

Figure 14:
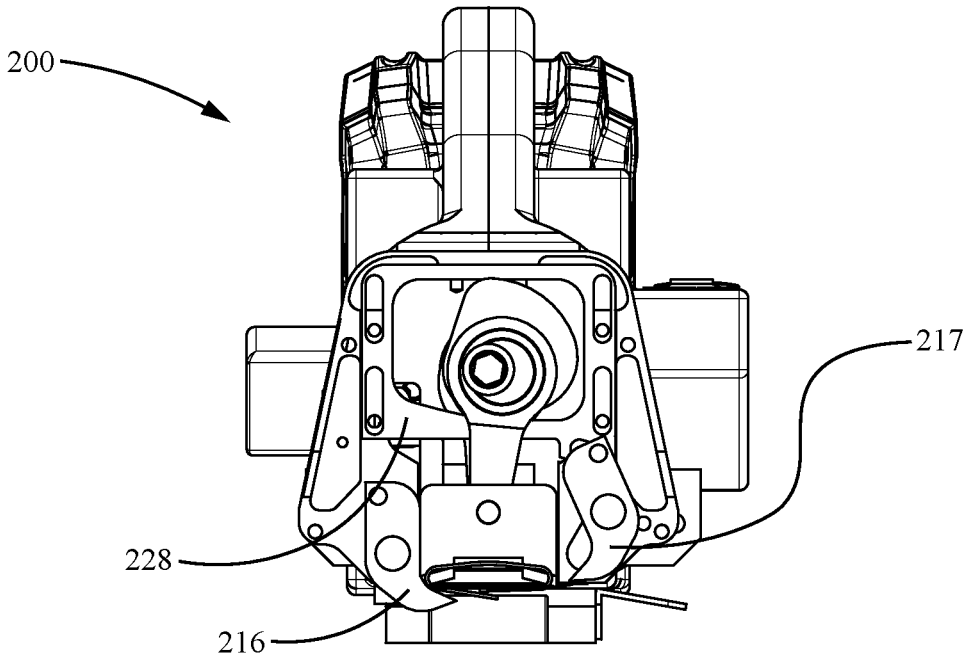
FIG. 14 is a front end view of a strapping tool according to an alternate embodiment of the present invention employing a fixed die and a movable die.

A second illustrative embodiment 200 of a strapping tool is illustrated in FIG. 14. Referring to FIG. 14, it can be seen that, in many respects, the second illustrative embodiment of the strapping tool is similar to that of the first illustrative embodiment. Moreover, many elements are common to both such embodiments. The primary difference between strapping tools 100 and 200 is the mechanism for positioning the dies used to create notches in strap 102.

Strapping tool 200 comprises a stationary die 216 and a moveable die 217. Stationary die 216 is permanently disposed such that it may cooperate with front punch 20 and/or rear punch 22 whenever either or both are thrust downward to create notches in seal member 106.

Moveable die 217 of strapping tool 200 is similar to right die 16*b* of strapping tool 100 in that each such die may be automatically rotated into a position to cooperate with front punch 20 and/or rear punch 22 to create notches in seal member 106. During the sealing operation of strapping tool 200, similar to strapping tool 100, motive power source 78 rotates drive shaft 118 which in turn rotates punch and die actuator 110. Through its rotation, punch and die actuator 110 cooperates with follower 228 to automatically rotate moveable die 217 into proper position for notching seal member 106.

Figure 15:
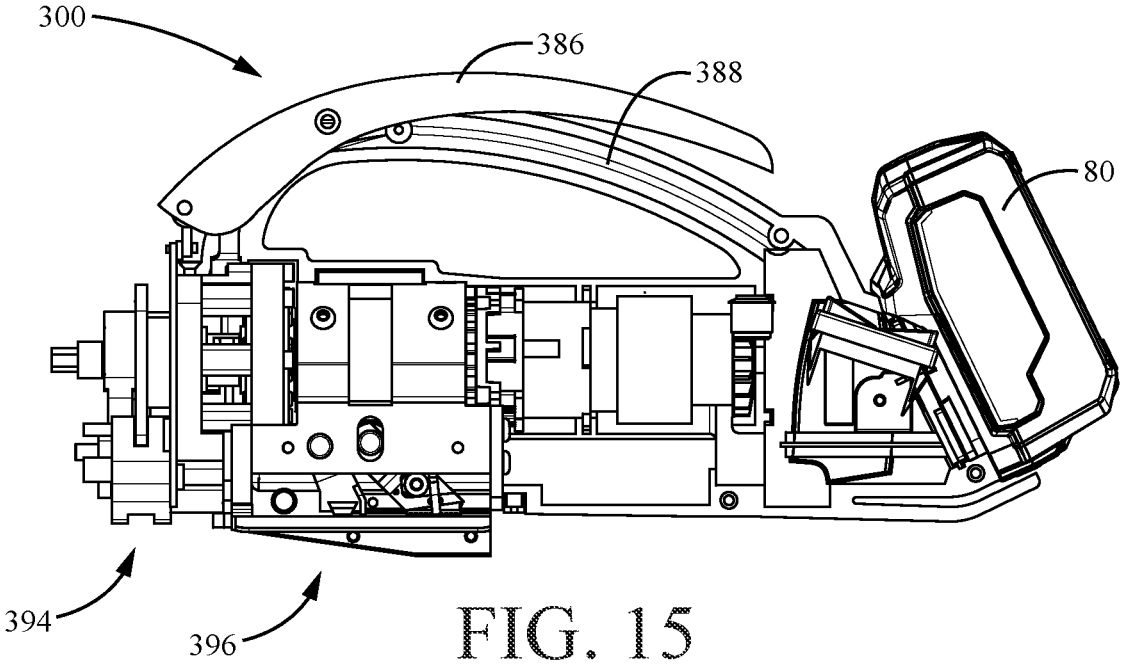
FIG. 15 is a side elevational view of a strapping tool according to another alternate embodiment employing a manual control for placing a die.
Figure 16:
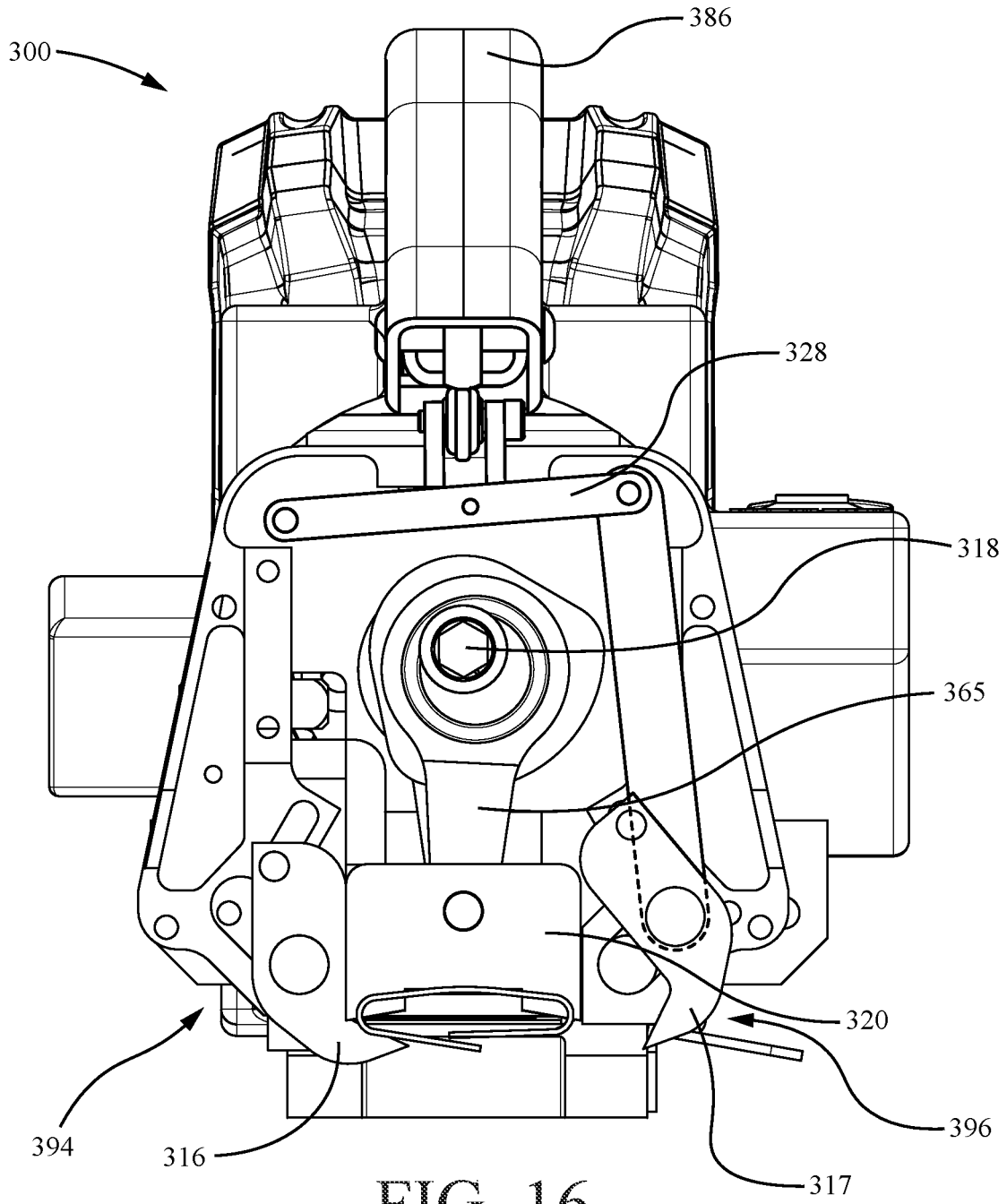
FIG. 16 is a front elevational view of the strapping tool of FIG. 15.

A third illustrative embodiment 300 of a strapping tool is illustrated in FIGS. 15 and 16. Referring to FIGS. 15 and 16, it can be seen that, in many respects, the third illustrative embodiment of the strapping tool is similar to that of the first and second illustrative embodiments. Moreover, many elements are common to all three embodiments. The primary difference between strapping tools 200 and 300 is the mechanism for positioning the dies used to create notches in seal member 106.

Similar to strapping tool 200, strapping tool 300 comprises a stationary die 316 and a moveable die 317. Stationary die 316 is permanently disposed such that it may cooperate with front punch 20 and/or rear punch 22 whenever either or both are thrust downward to create notches in seal member 106.

Moveable die 317 of strapping tool 300 is similar to moveable die 217 of strapping tool 200 in that it may be rotated into a position to cooperate with front punch 20 and/or rear punch 22 to create notches in seal member 106. The mechanism for performing such rotation, however, is different from either of strapping tools 100 and 200. A user manually causes movable die 317 to be rotated into its operative position. Specifically, strapping tool 300 comprises a displaceable handle portion 386 disposed above stationary handle portion 388. The front of displaceable handle portion is linked to actuator link 328 which in turn is linked to moveable die 317. When a user depresses displaceable handle portion 386, actuator link 328 is lifted and moveable die 317 is rotated into proper position for notching seal member 106. As with illustrative strapping tools 100 and 200, automated operation of punches 20 and 22 are controlled by motor 78.

In an alternative embodiment, both dies of the sealing assembly may be configured to remain stationary, rather than one or both dies being displaced.

Although the invention has been shown and described with respect to a certain embodiment or embodiments, it is apparent that this invention can be embodied in many different forms and that many other modifications and variations are possible without departing from the spirit and scope of this invention While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A strapping tool, comprising:

a motive power source;

a sealing assembly, the sealing assembly comprising a first punch and a die, the first punch and die configured to crimp or cut a notch in a strapping seal member and a piece of strapping so as to secure the piece of strapping around a package or bundle of items; and an actuator operatively coupled to the motive power source, the actuator configured to drive the first punch into the strapping seal member and the piece of strapping proximate to the die, thereby crimping or cutting the notch in the strapping seal member and the piece of strapping;

wherein the die is configured to move to a closed position, the die is configured to remain in the closed position, and then the first punch is configured to be driven into the strapping seal member and the piece of strapping proximate to the die.

2. The strapping tool according to claim 1, wherein the motive power source comprises one of: (i) a pneumatic motor, (ii) an electric motor, (iii) a liquid fuel-based motor, (iv) a piston, and (v) a handle.

3. The strapping tool according to claim 1, further comprising:

a cam member and a follower member, the cam member operatively coupling the follower member to the motive power source, and the follower member cooperating with the die and configured to position the die beneath the strapping seal member.

4. The strapping tool according to claim 1, wherein the die comprises a bottom support portion and a side support portion, the bottom support portion and the side support portion holding the strapping seal member in place during operation.

5. The strapping tool according to claim 1, further comprising:

a drive component operatively coupling the motive power source to the sealing assembly, the drive component configured to position the die beneath the strapping seal member.

6. The strapping tool according to claim 1, further comprising a tensioning assembly, the tensioning assembly configured to apply tension to the piece of strapping.

7. The strapping tool according to claim 6, further comprising a single control button configured to control the operation of both the tensioning assembly and the sealing assembly.

8. The strapping tool according to claim 1, wherein the sealing assembly further comprises an additional die that is configured to remain stationary.

9. The strapping tool according to claim 1, wherein the strapping seal member at least partially circumscribes a cross-sectional portion of the piece of strapping, and the first punch is configured to penetrate both the strapping seal member and the piece of strapping during the crimping or notching of the strapping seal member and the piece of strapping.

10. A strapping tool, comprising:

a motive power source;

a sealing assembly, the sealing assembly comprising a first punch and a die, the first punch and die configured to crimp or cut a notch in a strapping seal member and a piece of strapping so as to secure the piece of strapping around a package or bundle of items; and a die lifting assembly, the die lifting assembly including a handle member operatively coupled to the die; and wherein, when the handle member is depressed by a user, the die is configured to be raised out of a strapping pass line of the strapping tool.

* * * * *